US006437498B2

(12) United States Patent
Nakamura et al.

(10) Patent No.: US 6,437,498 B2
(45) **Date of Patent: *Aug. 20, 2002**

(54) WIDE-ANGLE DEFLECTION COLOR CATHODE RAY TUBE WITH A REDUCED DYNAMIC FOCUS VOLTAGE

(75) Inventors: Tomoki Nakamura; Shoji Shirai; Yasuharu Yatsu, all of Mobara (JP)

(73) Assignee: Hitachi, Ltd., Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 09/923,372

(22) Filed: Aug. 8, 2001

Related U.S. Application Data

(63) Continuation of application No. 09/260,067, filed on Mar. 2, 1999, now Pat. No. 6,304,026.

(30) Foreign Application Priority Data

Mar. 9, 1998 (JP) ..... 10-56712

(51) Int. Cl.[7] ..... H01J 29/50

(52) U.S. Cl. ..... 313/414; 313/409; 313/452; 315/382; 315/15

(58) Field of Search ..... 315/382, 382.1, 315/3, 14, 15; 313/409–417, 441–460, 461

(56) References Cited

U.S. PATENT DOCUMENTS

| | | | | |
|---|---|---|---|---|
| 3,740,607 | A | 6/1973 | Silzars et al. | |
| 3,943,281 | A | 3/1976 | Keller et al. | |
| 4,318,027 | A | 3/1982 | Hughes et al. | |
| 4,772,827 | A | 9/1988 | Osakabe | |
| 4,786,845 | A | 11/1988 | Kato et al. | |
| 4,988,929 | A | 1/1991 | Spanjer et al. | |
| 5,077,498 | A | 12/1991 | Odenthal | |
| 5,621,286 | A | 4/1997 | Tonjou et al. | |
| 6,304,026 | B1 * | 10/2001 | Nakamura et al. | 313/414 |

FOREIGN PATENT DOCUMENTS

| | | |
|---|---|---|
| JP | 59-215640 | 12/1984 |
| JP | 61-250933 | 11/1986 |
| JP | 63-10441 | 1/1988 |
| JP | 63-237337 | 10/1988 |
| JP | 63-250040 | 10/1988 |
| JP | 1-232645 | 9/1989 |
| JP | 4-237931 | 8/1992 |
| JP | 5-205651 | 8/1993 |

* cited by examiner

*Primary Examiner*—Ashok Patel
*Assistant Examiner*—Mariceli Santiago
(74) *Attorney, Agent, or Firm*—Antonelli, Terry, Stout & Kraus, LLP

(57) ABSTRACT

A three in-line beam type color CRT includes a focus electrode and an anode. The focus electrode includes a first focus sub-electrode supplied with a first fixed focus voltage and a second focus sub-electrode supplied with a second fixed voltage superposed with a dynamic voltage synchronized with beam deflection, and the first and second focus sub-electrodes form a quadrupole lens therebetween. Two side electron beams are deflected toward a center electron beam with increasing dynamic voltage in the quadrupole lens. An axial distance Lgf (mm) from a cathode side end of the first focus sub-electrode to an anode side end of the second focus sub-electrode, an axial distance Ls (mm) from the end of the second focus sub-electrode to the phosphor screen, and a useful diagonal dimension D (mm) of the phosphor screen satisfy 0.06×Ls (mm)≦Lgf (mm)≦26 (mm) and 1.50≦D/Ls≦1.70.

8 Claims, 9 Drawing Sheets

WIDE-ANGLE DEFLECTION COLOR CATHODE RAY TUBE WITH A REDUCED DYNAMIC FOCUS VOLTAGE

CROSS REFERENCE TO RELATED APPLICATION

This is a continuation of U.S. application Ser. No. 09/260,067, filed Mar. 2, 1999, now U.S. Pat. No. 6,304,026.

BACKGROUND OF THE INVENTION

The present invention relates to a cathode ray tube, and particularly to a color cathode ray tube having an in-line type electron gun configured so as to project three electron beams arranged horizontally in a line toward a phosphor screen.

Cathode ray tubes for use in TV receiver sets or information terminal display monitors have at least an electron gun comprised of plural electrodes and a phosphor screen and is provided with a deflection device for scanning plural electron beams emitted from the electron gun on the phosphor screen.

For these cathode ray tubes, the following technologies have been known for reproducing a good image over the entire phosphor screen.

An electrostatic quadrupole lens is formed of electrodes in an electron gun, and the strength of the electrostatic quadrupole lens is varied dynamically with deflection of the electron beam to obtain uniform display image over the phosphor screen as disclosed in Japanese Patent Application Laid-open No. Sho 61-250933 (Application No. Sho 60-90830, laid-open on Nov. 8, 1986), for example.

FIG. 11 is a schematic plan view of a color cathode ray tube having a electron gun employing the prior art electrostatic quadrupole lens. Reference numeral 1 denotes a glass envelope, 2 is a faceplate portion, 3 is a phosphor screen for displaying an image, 4 is a shadow mask, 5 is an internal conductive coating, 6, 7 and 8 are cathodes, 9 is a first grid electrode (a beam control grid electrode or G1 electrode, hereinafter grid electrodes are abbreviated as G electrodes), 10 is a G2 electrode (an accelerating electrode), 11 is a G3 electrode, 12 is a G4 electrode, 13 is a first G5 sub-electrode, 14 is a vertical electrode piece, 15 is a horizontal electrode piece, 16 is a second G5 sub-electrode, 17 is a G6 electrode (an anode), 18 is a shield cup, 19 is a deflection yoke (a deflection device), 20, 21 and 22 are center axes of the respective cathodes 6, 7 and 8, 23 and 24 are center axes of respective outer apertures in the G6 electrode 17. In FIG. 11, the phosphor screen 3 comprising alternate lines of three color emitting phosphors is coated on the inner surface of the faceplate portion 2 of the glass envelope 1.

The center axes 20, 21, 22 of the cathodes 6, 7, 8 are aligned with those of apertures corresponding to the respective cathodes in the G1 electrode 9, the G2 electrode 10, the G3 electrode 11, the G4 electrode 12 for forming a pre-main lens in cooperation with the G3 electrode 11, the first G5 sub-electrode 13 and the second G5 sub-electrode 16 of the focus electrode serving as one lens component of a main lens and the shield cup 18, and arranged approximately parallel with each other in a common horizontal plane.

The center axis of the center aperture in the G6 electrode 17 serving as the other lens component, an anode, of the main lens is aligned with the center axis 21, but the center axes 23, 24 of two outer apertures in the G6 electrode 17 are displaced slightly outwardly with respect to the corresponding center axes 20, 22 in the common horizontal plane.

The four vertical electrode pieces 14 are attached to the end of the first G5 sub-electrode 13 which is one on the cathode side of the two G5 sub-electrodes into which the focus electrode is divided such that the four vertical electrode pieces 14 sandwich the respective apertures in the end of the first G5 sub-electrodes 13 horizontally.

A pair of horizontal electrode pieces 15 are attached t6 the end of the second G5 sub-electrode 16 on the first G5 sub-electrode 13 side thereof such that the horizontal electrode pieces 15 sandwich three apertures in the end of the second G5 sub-electrode 16 vertically. These electrode pieces 14, 15 form an electrostatic quadrupole lens therebetween.

A plurality (usually three) of electron beams emitted from the cathodes 6, 7, 8 enter the main lens along the center axes 20, 21, 22 of the corresponding cathodes. The second G5 sub-electrode 16 serving as the focusing electrode is supplied with a focus voltage of about 5 kV to about 10 kV, the G6 electrode 17 serving as the anode is supplied with an accelerating voltage of about 20 to about 30 kV, and the G6 electrode 17 is at the same potential with the shield cup 18 and the internal conductive coating 5 coated on the inner surface of the glass envelope 1.

The center apertures in the first and second G5 sub-electrodes 13, 16 of the focusing electrode and the G6 electrode 17 are coaxial with each other and aligned with the center axis 21, and consequently the main lens in the c-enter is axially-symmetrical, the center electron beam travels straight along the center axis after being focused by the main lens.

The center axes of the two outer apertures in the end of the G6 electrode 17 facing the second G5 sub-electrode 16 are displaced horizontally outwardly with respect to those of the two outer apertures in the second G5 sub-electrode 16 and non-axially symmetrical main lenses are formed in the paths of the two outer electron beams.

The outer electron beams traverse a portion displaced toward the center electron beam from the lens axis in a diverging lens formed in the G6 electrode 17 (the anode) side portion of the main lens region and receive a focusing action by the main lens and a force converging the outer electron beams toward the center electron beam at the same time. The three electron beams are converged at a point on the shadow mask 4. This convergence of three electron beams at the central portion of the phosphor screen is called static convergence (hereinafter abbreviated to "STC").

The three electron beams are subjected to color selection by the shadow mask 4 such that portions of each electron beam passed by the apertures in the shadow mask 4 excite only phosphor elements of its corresponding color on the phosphor screen 3 to luminescence.

The deflection yoke 19 for scanning the electron beams *6n* the phosphor screen 3 is mounted around the funnel portion 32 for connecting the faceplate 2 and the neck portion 31 housing the electron gun. The deflection yoke 19 for use in color cathode ray tubes for monitors of information terminals employs a so-called saddle-saddle type deflection yoke having horizontal and vertical deflection windings wound in a saddle configuration so as to prevent leakage of magnetic fields from the monitor sets.

It is known that the three electron beams are at all points of the phosphor screen when the three electron beams are initially converged at the center of the phosphor screen, by combination of a so-called in-line type electron gun having initially three electron beam paths in a horizontal plane and a so-called self-converging deflection yoke generating specific non-homogeneous magnetic fields.

In general, there is a problem with the self-converging deflection yoke in that resolution at the periphery of the screen is degraded due to deflection defocusing increased by its non-homogeneous magnetic fields.

To solve this problem, the electrostatic quadrupole lens is employed. The first G5 sub-electrode 13 is supplied with a fixed focus voltage Vf, and the second G5 sub-electrode 16 is supplied with the fixed focus Vf superposed with a dynamic voltage dVf synchronized with deflection currents supplied to the deflection yoke.

With increase in deflection of the electron beams, the voltage difference between the first and second G5 sub-electrodes 13 and 16 increases and the lens strength of the electrostatic quadrupole lens formed by the vertical and horizontal electrode pieces 14 and 15 increases and provides a greatly astigmatic shape to the electron beam spots.

When the potential of the second G5 sub-electrode 16 is higher than that of the first G5 sub-electrode 13, the astigmatism produced is such that an intense core of an electron beam spot is elongated vertically and a low intensity halo of the electron beam spot is elongated horizontally to cancel the astigmatism introduced by the deflection of the electron beam and to improve resolution at the periphery of the screen. When the electron beam is not deflected, by making the potential of the first G5 sub-electrode 13 equal to that of the second G5 sub-electrode 16 to eliminate the non-axially symmetrical lens, the astigmatism is not produced and resolution does not deteriorate at the center of the screen.

In cathode ray tubes of this type, the distance between the main lens and the periphery (corners) of the screen is longer than that between the main lens and the center of the screen, the beam focusing condition at the center of the screen differs from that at the periphery of the screen, and there is a problem in that, if an electron beam is focused for the best at the center of the screen, the electron beam is defocused at the periphery of the screen, and the resolution is degraded at the periphery of the screen.

But in the electron guns employing the electrostatic quadrupole lens, when the electron beam is deflected toward the periphery of the screen, the potential of the second G5 sub-electrode 16 is increased, the potential difference between the second G5 sub-electrode 16 and the anode is decreased and the strength of the main lens is weakened.

Therefore the beam focus point (the image point) is moved toward the phosphor screen 3, the electron beam can be focused on the screen at its periphery also and deterioration in resolution at the screen periphery is prevented. Curvature of the image field as well as astigmatism can be dynamically corrected.

When the prior art is applied to a color cathode ray tube having a maximum diagonal deflection angle of more than 90 degrees, for example, the axial length of which is shortened by increasing its deflection angle for use in information terminal display monitors and the like, a required dynamic voltage becomes too high for use in monitors if the dynamic voltage becomes high, transistors serving as drivers in the dynamic voltage circuit unit have to withstand greatly higher voltages, presently-used dynamic voltage circuit cannot be used without design changes, and the cathode ray tube cannot be replaced separately from the monitor set.

SUMMARY OF THE INVENTION

It is an object of the present invention to solve the above problems and to provide a color cathode ray tube which makes possible the use of presently-used dynamic voltage circuit units and whose axial length is shortened.

To accomplish the above objects, in accordance with an embodiment of the present invention, there is provided a color cathode ray tube comprising: a phosphor screen; an in-line type electron gun comprising an electron beam generating section having a cathode, a beam control electrode and an accelerating electrode for projecting three electron beams of a center electron beam and two side electron beams arranged approximately in parallel with each other in a horizontal plane toward the phosphor screen, a focus electrode, and an anode adjacent to the focus electrode and forming a main lens in cooperation with the focus electrode for focusing the three electron beams on the phosphor screen; and a deflection yoke for deflecting the three electron beams horizontally and vertically, the focus electrode including at least a first focus sub-electrode supplied with a first fixed focus voltage and a second focus sub-electrode supplied with a second fixed voltage superposed with a dynamic voltage varied in synchronism with deflection of the three electron beams on the order named from the cathode, the first focus sub-electrode and the second focus sub-electrode forming an electrostatic quadrupole lens therebetween, the two side electron beams being deflected toward the center electron beam with increase of the dynamic voltage in the electrostatic quadrupole lens, and an axial distance Lgf (mm) measured from an end of the first focus sub-electrode on a cathode side thereof to an end of the second focus sub-electrode on an anode side thereof, an axial distance Ls (mm) measured from the end of the second focus sub-electrode to the phosphor screen, and a useful diagonal dimension D (mm) of the phosphor screen satisfying a following relationship: $0.06 \times Ls\ (mm) \leqq Lgf\ (mm) \leqq 26\ (mm)$, and $1.50 \leqq D/Ls \leqq 1.70$.

To accomplish the above objects, in accordance with another embodiment of the present invention, there is provided a color cathode ray tube comprising: a phosphor screen; an in-line type electron gun comprising an electron beam generating section having a cathode, a beam control electrode and an accelerating electrode for projecting three electron beams of a center electron beam and two side electron beams arranged approximately in parallel with each other in a horizontal plane toward the phosphor screen, a focus electrode, and an anode adjacent to the focus electrode and forming a main lens in cooperation with the focus electrode for focusing the three electron beams on the phosphor screen; and a deflection yoke for deflecting the three electron beams horizontally and vertically, the focus electrode including at least a first focus sub-electrode supplied with a first fixed focus voltage and a second focus sub-electrode supplied with a second fixed voltage superposed with a dynamic voltage varied in synchronism with deflection of the three electron beams on the order named from the cathode, the first focus sub-electrode and the second focus sub-electrode forming an electrostatic quadrupole lens therebetween, the two side electron beams being deflected toward the center electron beam with increase of the dynamic voltage in the electrostatic quadrupole lens, a maximum diagonal deflection angle of the three electron beams across the phosphor screen being larger than 90 degrees, but smaller than 110 degrees, and an axial distance Lgf (mm) measured from an end of the first focus sub-electrode on a cathode side thereof to an end of the second focus sub-electrode on an anode side thereof, and an axial distance Ls (mm) measured from the end of the second focus sub-electrode to the phosphor screen satisfying a following relationship: $0.06 \times Ls\ (mm) \leqq Lgf\ (mm) \leqq 26\ (mm)$.

To accomplish the above objects, in accordance with an embodiment of the present invention, there is provided a color cathode ray tube comprising: a phosphor screen; an in-line type electron gun comprising an electron beam generating section having a cathode, a beam control electrode and an accelerating electrode for projecting three electron beams of a center electron beam and two side electron beams arranged approximately in parallel with each other in a horizontal plane toward the phosphor screen, a focus electrode, and an anode adjacent to the focus electrode and forming a main lens in cooperation with the focus electrode for focusing the three electron beams on the phosphor screen; and a deflection yoke for deflecting the three electron beams horizontally and vertically, the focus electrode including at least a first focus sub-electrode supplied with a first fixed focus voltage and a second focus sub-electrode supplied with a second fixed voltage superposed with a dynamic voltage varied in synchronism with deflection of the three electron beams on the order named from the cathode, the first focus sub-electrode and the second focus sub-electrode forming an electrostatic quadrupole lens therebetween, the two side electron beams being deflected toward the center electron beam with increase of the dynamic voltage in the electrostatic quadrupole lens, a maximum useful diagonal dimension of the phosphor screen being greater than 410 mm, a maximum diagonal deflection angle of the three electron beams across the phosphor screen being approximately 100 degrees, and an axial distance Lgf (mm) measured from an end of the first focus sub-electrode on a cathode side thereof to an end of the second focus sub-electrode on an anode side thereof, and an axial distance Ls (mm) measured from the end of the second focus sub-electrode to the phosphor screen satisfying a following relationship: $0.06 \times Ls\ (mm) \leqq Lgf\ (mm) \leqq 19\ (mm)$.

The present invention is not limited to color cathode ray tubes having an electron gun of the type having the above-mentioned number of grid electrodes, but also is applicable to color cathode ray tubes having a conventional electron gun of the type having the number other than the above-mentioned number of grid electrodes.

BRIEF DESCRIPTION OF THE DRAWINGS

In the accompanying drawings, in which like reference numerals designate similar components throughout the figures, and in which.

DETAILED DESCRIPTION OF THE PREFERRED EMBODIMENTS

The present invention will now be described in detail with reference to the accompanying drawings.

Figure 1:
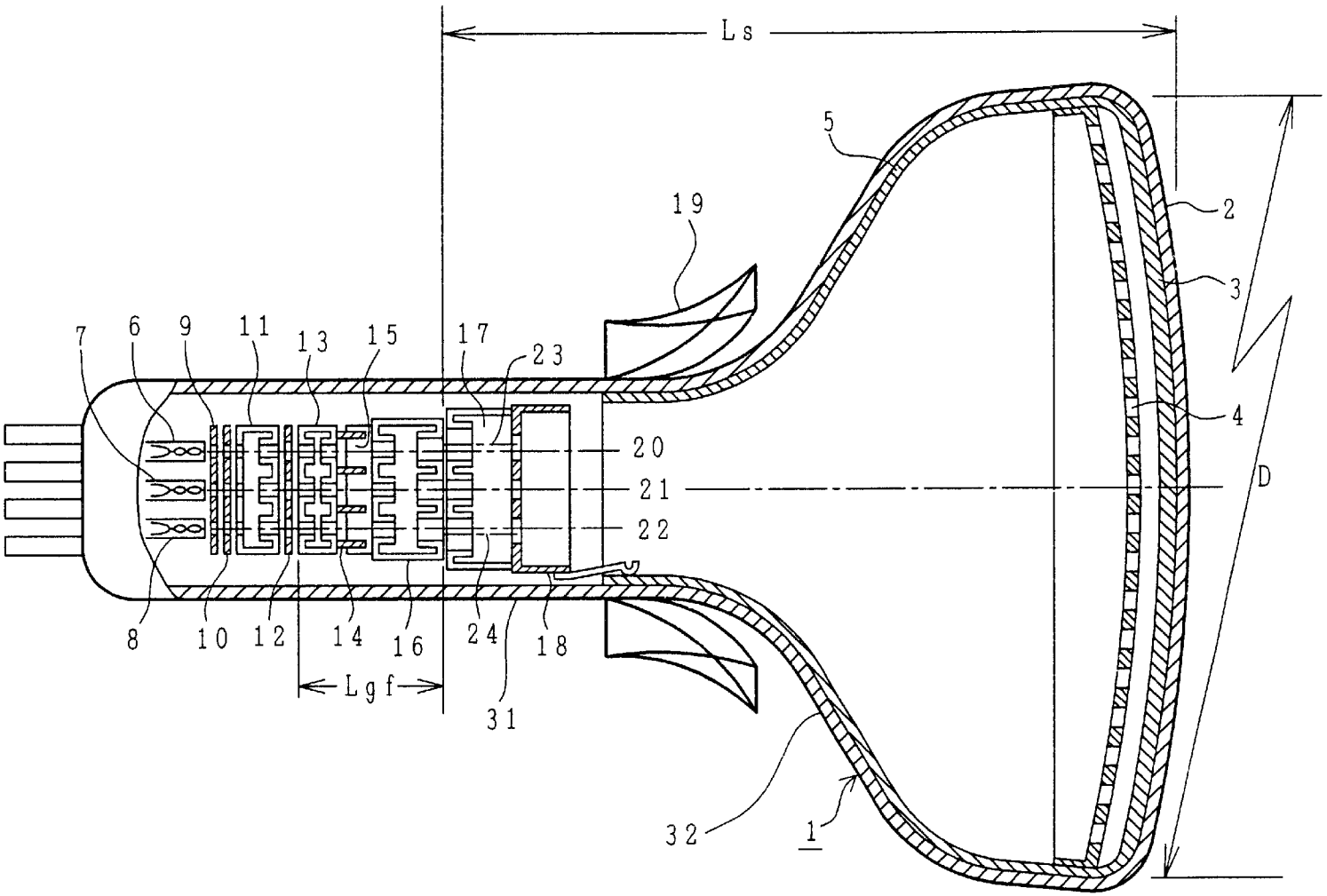
FIG. 1 is a schematic plan view of a color cathode ray tube having an electron gun employing an electrostatic quadrupole lens for explaining a first embodiment of the present invention.
Figure 11:
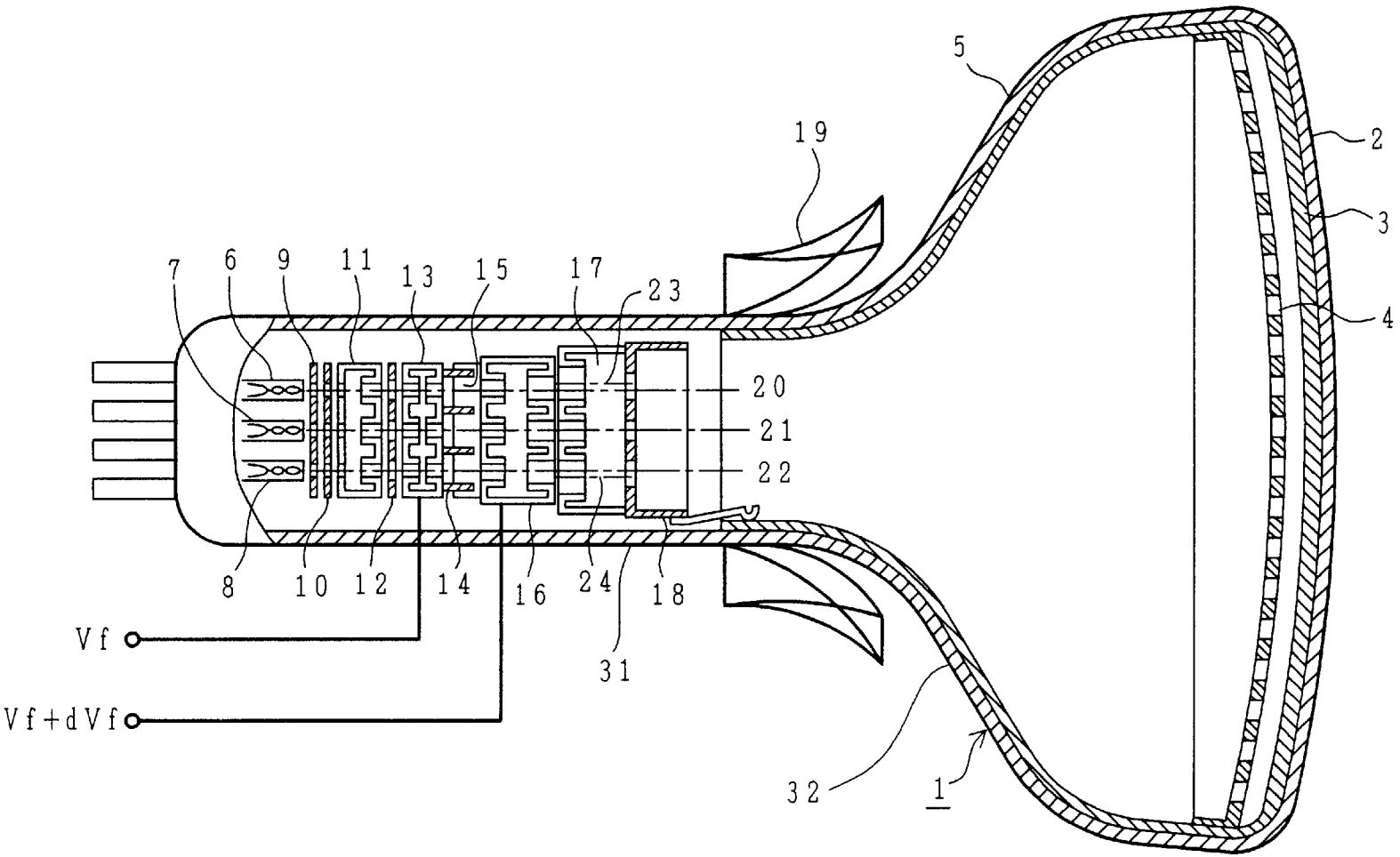
FIG. 11 (PRIOR ART)
FIG. 11 is a schematic plan view of a color cathode ray tube having a prior art electron gun employing an electrostatic quadrupole lens.

FIG. 1 is a schematic plan view of a color cathode ray tube having an electron gun employing an electrostatic quadrupole lens for explaining a first embodiment of the present invention, wherein the same reference numerals as utilized in FIG. 11 designate corresponding portions in FIG. 1.

The electrode structure in this embodiment may be similar to that in FIG. 11, except that the axial length of a color cathode ray tube of this embodiment is shortened, consequently the detailed description of the electrode structure depicted in FIG. 11 is applicable in this embodiment and is omitted here.

In this embodiment shown in FIG. 1, the focus electrode length Lgf (mm), the lens-screen distance Ls (mm) and the useful diagonal dimension D (mm) of the phosphor screen 3 satisfy the following inequalities:

$$0.06 \times Ls\ (mm) \leqq Lgf\ (mm) \leqq 26\ (mm) \quad (1)$$

$$1.50 \leqq D/Ls \leqq 1.70 \quad (2),$$

where the focus electrode length Lgf (mm) is defined as the sum of axial lengths of the first G5 sub-electrode 13 and the second G5 sub-electrode 16 and the spacing therebetween which form an electrostatic quadrupole lens, or, if the first and second G5 sub-electrodes 13, 16 overlap each other, the sum of the axial lengths of the first and second G5 sub-electrodes 13, 16 minus the length of the overlap therebetween, that is, an axial distance from the end of the first G5 sub-electrode 13 on its cathode side to the end of the second G5 sub-electrode 16 on its G6 electrode side, and the lens-screen distance Ls (mm) is defined as an axial distance measured from the end of the second G5 sub-electrode 16 on the G6 electrode 17 side thereof which forms a main lens in cooperation with the G6 electrode 17 serving as an anode, to the phosphor screen 3.

The following explains the above relationship in detail.

Figure 2:
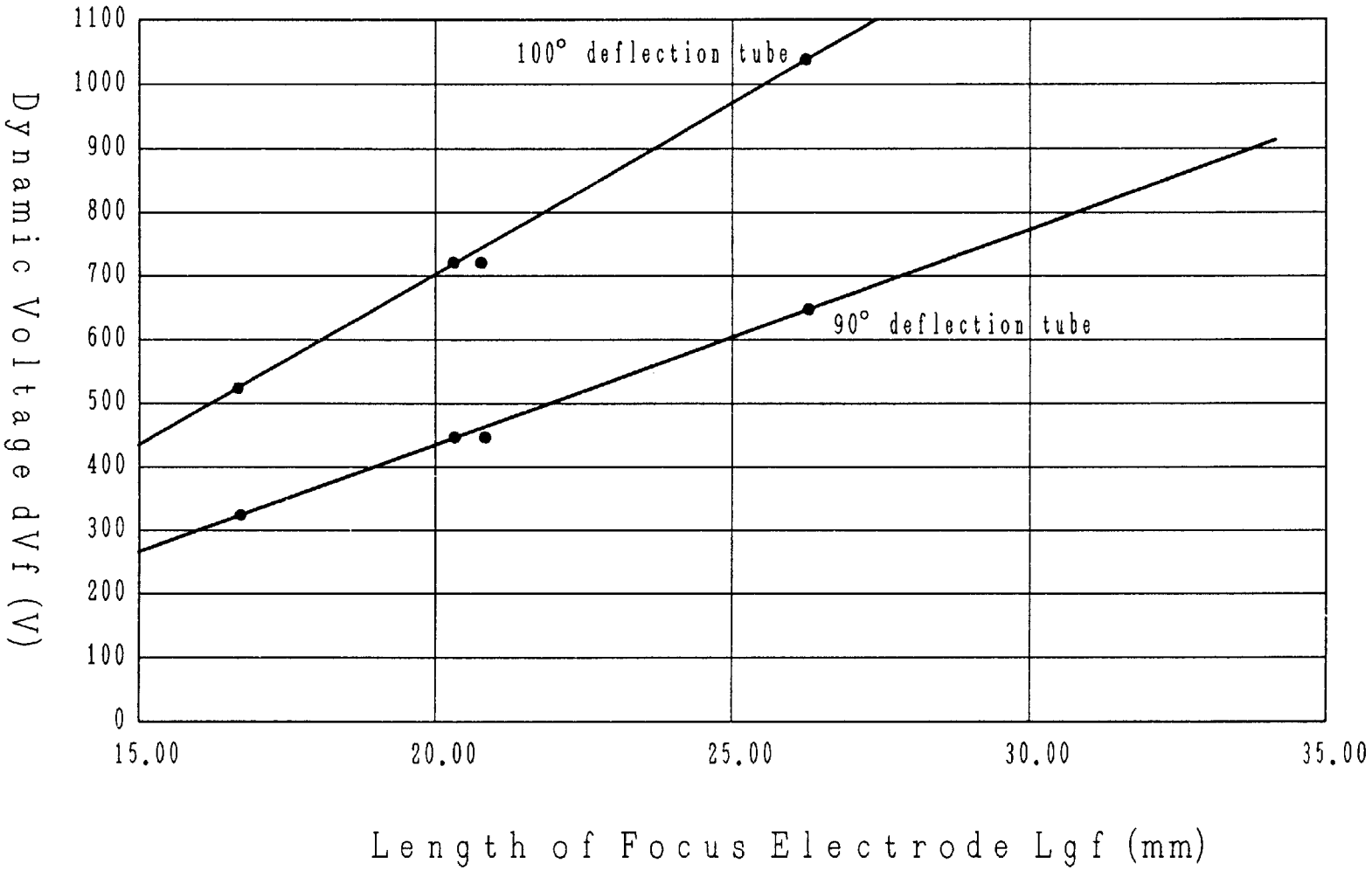
FIG. 2 is a graph showing a relationship between a dynamic voltage dVf (V) and an axial distance Lgf (mm) from an end of a first focus sub-electrode on a cathode side thereof to an end of a second focus sub-electrode on an anode side thereof.

FIG. 2 shows a relationship between the dynamic voltage dVf (V) and the focus electrode length Lgf (mm) in an electron gun wherein the focus electrode is divided into two focus sub-electrodes such that an electrostatic quadrupole lens is formed therebetween, one of them is adjacent to the anode to form a main lens in cooperation with the anode, and the focus electrode length Lgf is defined as the sum of axial lengths of the two focus sub-electrodes and the spacing therebetween, or the sum of the axial lengths of the two sub-electrodes minus the length of the overlap therebetween, if the two sub-electrodes overlap each other.

The deflection frequency for a color cathode ray tube incorporated in a display monitor for information terminals and the like is high, the frequency of the dynamic voltage synchronized with deflection of the electron beam is high, and consequently the magnitude of the dynamic voltage actually applied to the color cathode-ray tube is reduced and is greatly distorted in waveform because of the limited capacity of driver circuits of the monitor set.

Considering the capacity of presently-used driver circuits, the dynamic voltage should not exceed 650 volts. To realize a compact monitor set for information terminals and the like by reducing its depth, it is necessary to make the axial length of a color cathode ray tube shorter than that of ordinary 90°-deflection color cathode ray tubes.

FIG. 2 shows that, for color cathode ray tubes of a maximum diagonal deflection angle of more than 90°, the dynamic voltage can be made not to exceed 650 volts by selecting the length Lgf to be about 26 mm and below. In the case of a color cathode ray tube of a maximum diagonal deflection angle of 100° corresponding to a maximum useful screen diagonal dimension, for example, the length Lgf has to be selected to be about 19 mm and below as indicated in FIG. 2, because the optimum dynamic voltage becomes higher as the deflection angle increases.

Figure 3:
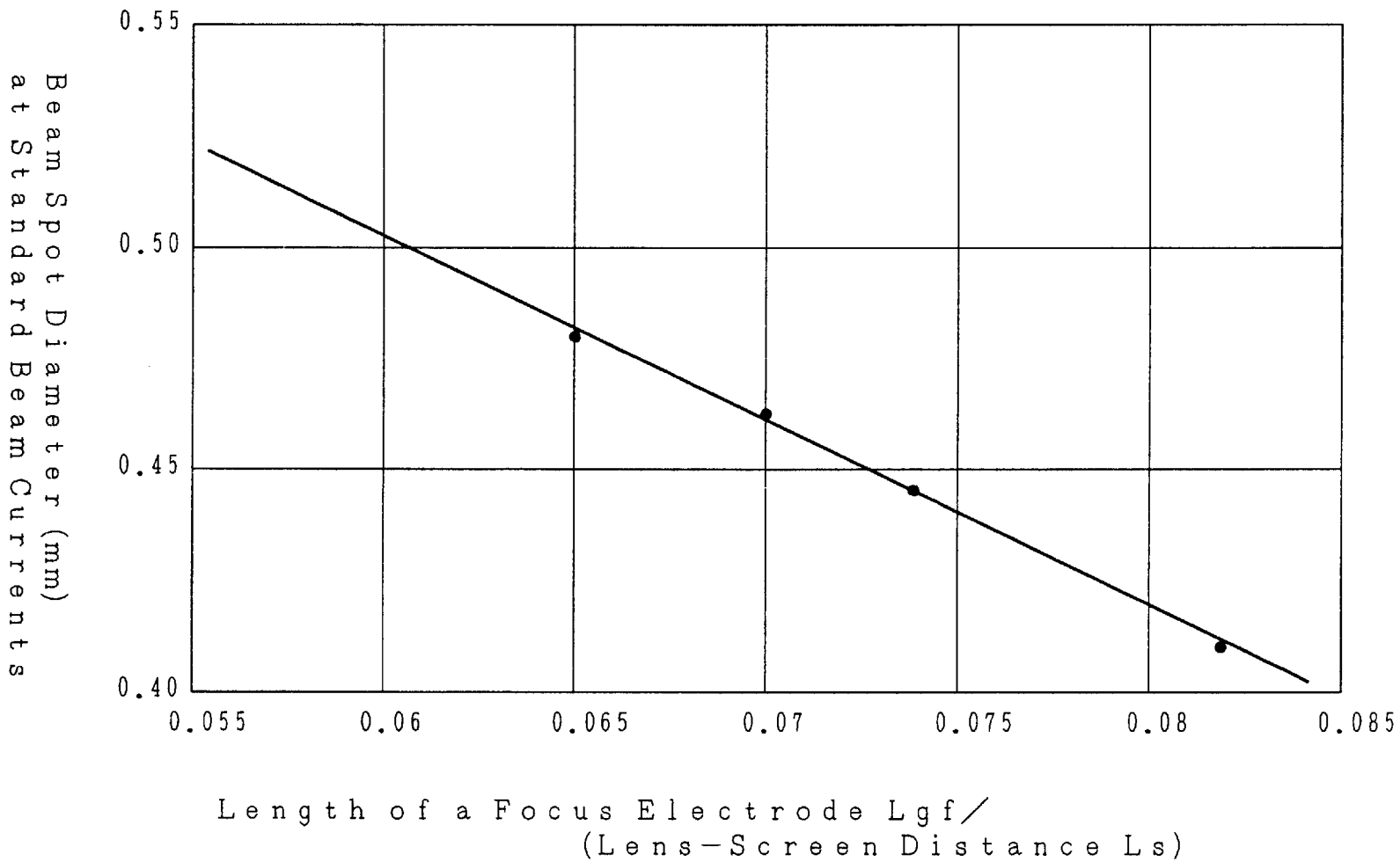
FIG. 3 is a graph showing a relationship between an electron beam spot diameter on the phosphor screen at a standard beam current and a ratio Lgf/Ls of the axial distance Lgf (mm) of the focus electrode to an axial distance Ls (mm) from the end of the second focus sub-electrode to the phosphor screen.

FIG. 3 is a plot of a relationship between electron beam spot diameters on the phosphor screen and a ratio Lgf/Ls of the focus electrode length Lgf (mm) to the lens-screen distance Ls (mm) at standard beam currents for respective screen sizes, experimentally obtained by the present inventors, by using various electron guns whose anode voltages are in a range of 25 kV–28 kV and whose beam cutoff voltages are in a range of 110 V–130 V, where the second focus sub-electrode and the anode form a main lens between the facing ends thereof, the standard beam currents provide recommended brightness for respective screen sizes and are defined as 0.00115 ($\mu$A/mm$^2$)×D(mm)$^2$, D being a useful diagonal dimension of the phosphor screen. As specific examples, the approximate standard beam currents are 200 $\mu$A, 250 $\mu$A, and 300 $\mu$A for useful diagonal screen dimensions D of 41 cm, 46 cm, and 51 cm, respectively.

Color cathode ray tubes for use in information terminal displays and the like are required to produce a high information content, large capacity and good resolution display, and therefore it is desirable that dot aperture patches in a shadow mask is not larger than 0.28 mm and the number of display dots in a horizontal direction on the screen is not smaller than 1000 for a useful diagonal phosphor screen dimension not smaller than 41 cm. In this case the electron beam spot at the center of the screen needs to be 0.5 mm and below for the above-mentioned standard electron beam current. This subject is discussed in "In-Line Type High-Resolution Color Display Tube", National Technical Report, February 1982, Vol. 28, No. 1, for example. FIG. 3 indicates this requirement on beam spot diameters is satisfied by selecting Lgf/Ls not to be smaller than about 0.06.

From the above explanation, the following inequality has to be satisfied:

$$0.06 \times Ls\ (mm) \leqq Lgf\ (mm) \leqq 26\ mm$$

to obtain a cathode ray tube capable of a high information content large capacity and high resolution display and having a maximum diagonal deflection angle made larger than 90° to reduce the depth of information terminal monitors and the like incorporating the cathode ray tube.

The following explains a specific embodiment in which the above relationship is applied to the color cathode ray tube in FIG. 1.

When an electron gun including an electrostatic quadrupole lens is incorporated into a color cathode ray tube having the useful diagonal screen dimension=41 cm, the maximum diagonal deflection angle corresponding to the useful diagonal screen dimension=100°, the dot aperture pitch in the shadow mask 0.28 mm, and when the diagonal phosphor screen dimension D=410 mm, the lens-screen distance Ls=258 mm, the length Lg5 of the G5 electrode=17.9 mm in FIG. 1, 0.06×Ls=15.48 mm satisfies the inequality. And the standard electron beam current=0.00115 ($\mu$A/mm$^2$)×D(mm)$^2$=193 $\mu$A.

The ratio Lgf/Ls of the focus electrode length Lgf (mm) containing the electrostatic quadrupole lens to the lens-screen distance Ls (mm)=Lg5/Ls=0.065, and FIG. 3 indicates the beam spot diameter for this ratio 0.48 mm and satisfies the objective of 0.5 mm.

In another embodiment where the useful diagonal screen dimension=46 cm, the maximum diagonal deflection angle=100°, and when the diagonal phosphor screen dimension D=460 mm, the lens-screen distance Ls=282 mm, the length Lg5 of the G5 electrode=17.9 mm in FIG. 1, 0.06×Ls=16.92 mm satisfies the inequality. The standard electron beam current=0.00115 ($\mu$A/mm$^2$)×D(mm)$^2$=243 $\mu$A.

The ratio Lgf/Ls of the focus electrode length Lgf (mm) containing the electrostatic quadrupole lens to the lens-screen distance Ls (mm)=Lg5/Ls=0.063, and FIG. 3 indicates the beam spot diameter for this ratio 0.49 mm and satisfies the objective of 0.5 mm.

In a conventional color cathode ray tube having a maximum diagonal deflection angle of 90°, the approximate lens-screen distances Ls are 293 mm, 326 mm and 355 mm for the useful diagonal screen dimensions of 41 cm, 46 cm, and 51 cm, respectively, and the ratios D/Ls of the diagonal phosphor screen dimension D to the lens-screen distance Ls are smaller than 1.45 for all the above conventional color cathode ray tubes.

On the other hand, in a color cathode ray tube having a maximum diagonal deflection angle of 100° in accordance with the present invention, the approximate lens-screen distances Ls are 258 mm and 282 mm for the useful diagonal screen dimensions of 41 cm and 46 cm, respectively, and the ratios D/Ls of the diagonal phosphor screen dimension D to the lens-screen distance Ls are approximately 1.60 for these tubes.

The above values of the lens-screen distances Ls were selected such that interference of magnetic deflection fields leaking from the deflection yoke does not distort the shape of electron beam spots on the phosphor screen beyond an allowable limit and the end on the anode side of the focus sub-electrode which forms a main lens in cooperation with the anode is disposed as close to the phosphor screen as possible.

Although color cathode ray tubes having a maximum diagonal deflection angle of approximately 110° have been used for color TV receivers, it is difficult to employ a color cathode ray tube of approximately 110° deflection in an information terminal display requiring a dynamic focusing circuit for a high information content, large capacity and high resolution display because of the magnitude of the dynamic focus voltage limited by capacity of the circuit.

The color cathode ray tube of the present invention adopts a maximum diagonal deflection angle (a maximum total sweep across the diagonal) larger than 90° in order to make its axial length shorter than that of a conventional color cathode ray tube having a maximum diagonal deflection angle of 90°, while still keeping the maximum diagonal deflection angle less than 110° to reduce the magnitude of the dynamic voltage of the dynamic focus circuit in the information terminal display monitor. In this color cathode ray tube having a maximum diagonal deflection angle larger than 90°, but smaller than 110°, the ratio D/Ls of the diagonal phosphor screen dimension D to the lens-screen distance Ls is selected to be in a range of about 1.50 to about 1.70 such that the overall axial length of the cathode ray tube is made as short as possible, but such that the main lens of the electron gun is free from adverse effects of interference with leakage magnetic fields from the deflection yoke.

This embodiment provides a color cathode ray tube of capable of making a low dynamic voltage compatible with excellent focus characteristics and making its maximum diagonal deflection angle larger than 90° and its overall length shorter.

Figure 4:
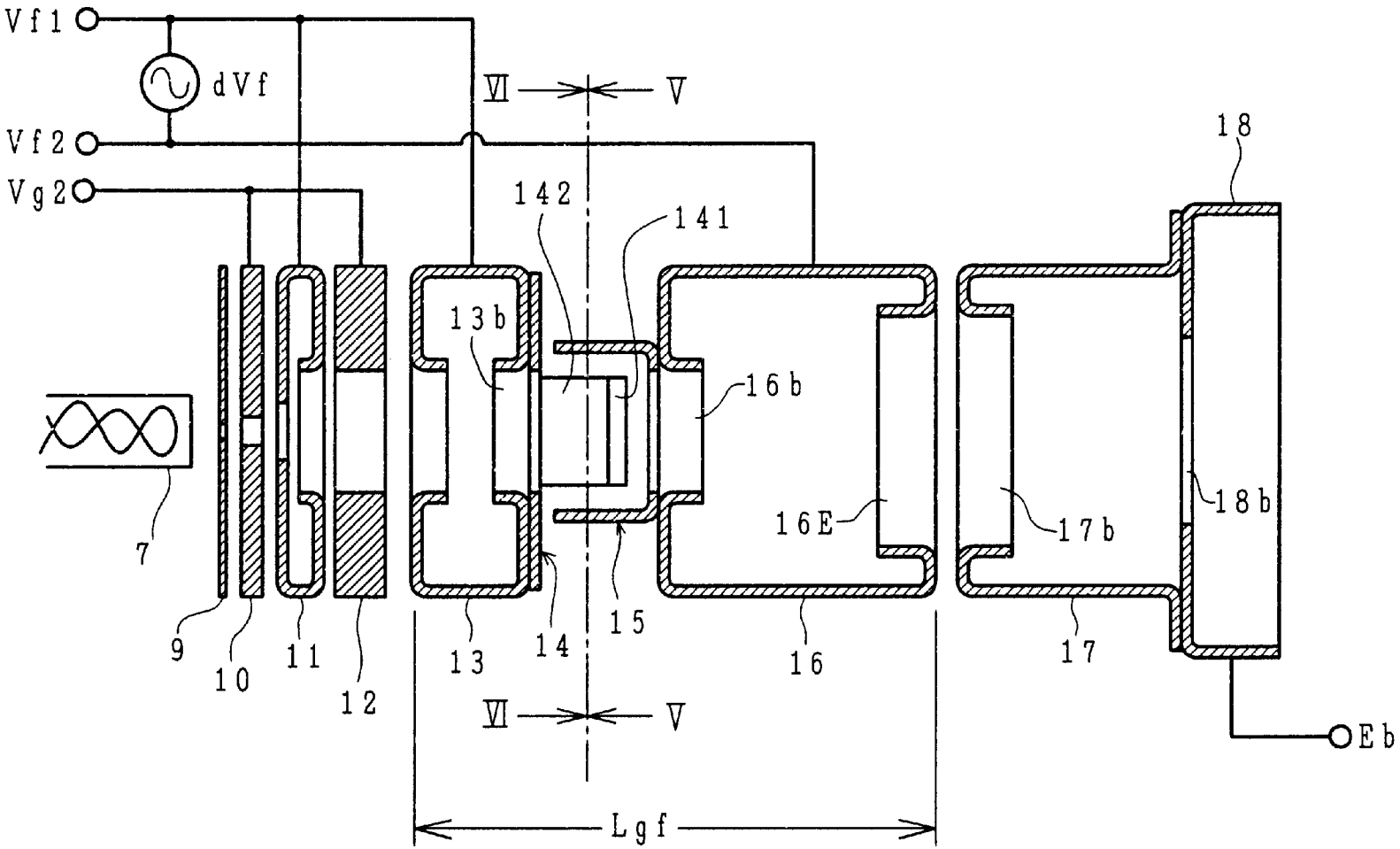
FIG. 4 is a schematic cross-sectional view of a first embodiment of an electron gun for a color cathode ray tube of the present invention.

FIG. 4 is a schematic cross-sectional view of a first embodiment of an electron gun of a color cathode ray tube of the present invention, taken along the center axis of the in-line type electron gun.

In FIG. 4, reference numeral 7 denotes a cathode rode, for protecting a center electron beam, 9 is a G1 electrode, 10 is a G2 electrode, 11 is a G3 electrode, 12 is a G4 electrode, 13 is a first G5 sub-electrode, 14 is a vertical electrode piece for forming an electrostatic quadrupole lens, 15 is a horizontal electrode piece for forming the electrostatic quadrupole lens in cooperation with the vertical electrode piece 14, 16 is a second G5 sub-electrode, 17 is a G6 electrode serving as an anode, and 18 is a shield cup.

Reference 13*b* denotes a center electron beam aperture in the first G5 sub-electrode 13, 16*b* is a center electron beam aperture in the end of the second G5 sub-electrode 16 facing the first G5 sub-electrode 13, 16 E is a center electron beam aperture in the end of the second G5 sub-electrode 16 facing the G6 electrode 17, 17*b* is a center electron beam aperture in the end of the G6 electrode 17 facing the second G5 sub-electrode 16, and 18*b* is a center electron beam aperture in the shield cup 18.

In FIG. 4, the C2 electrode 10 is electrically connected to the G4 electrode 12, the G3 electrode 11 is electrically connected to the first G5 sub-electrode 13, and the main lens is formed by five grid electrodes which include the G3 electrode 11, the G4 electrode 12, the first G5 sub-electrode 13, the second G5 sub-electrode 16 and the G6 electrode 17, and is a so-called multi-stage type main lens.

The G3 electrode 11 and the first G5 sub-electrode 13 are supplied with a common focus voltage Vf1 of about 5 kV to about 10 kV, and the G4 electrode 12 is supplied with a low voltage vg2 in common with the G2 electrode 10.

In the multi-stage type main lens of this structure, the G3 electrode 11, the G4 electrode 12 and the first G5 sub-electrode 13 form a uni-potential type lens therebetween, the second G5 sub-electrode 16 and the G6 electrode 17 form a bi-potential type lens therebetween, and a combination of these lenses realizes a low-aberration main lens called a U-B type main lens which improves resolution.

In FIG. 4, the bi-potential type lens formed by the second G5 sub-electrode 16 and the G6 electrode 17 is a non-cylindrical main lens which is disclosed in Japanese Patent Application Laid-Open No. Sho 59-215640 Application No. Sho 58-89132, laid-open on Dec. 5, 1984 for example, to reduce aberration in the main lens and to improve resolution.

The following explains the structure of electrodes for forming the electrostatic quadrupole lens between the first G5 sub-electrode 13 and the second G5 sub-electrode 16.

Figure 5:
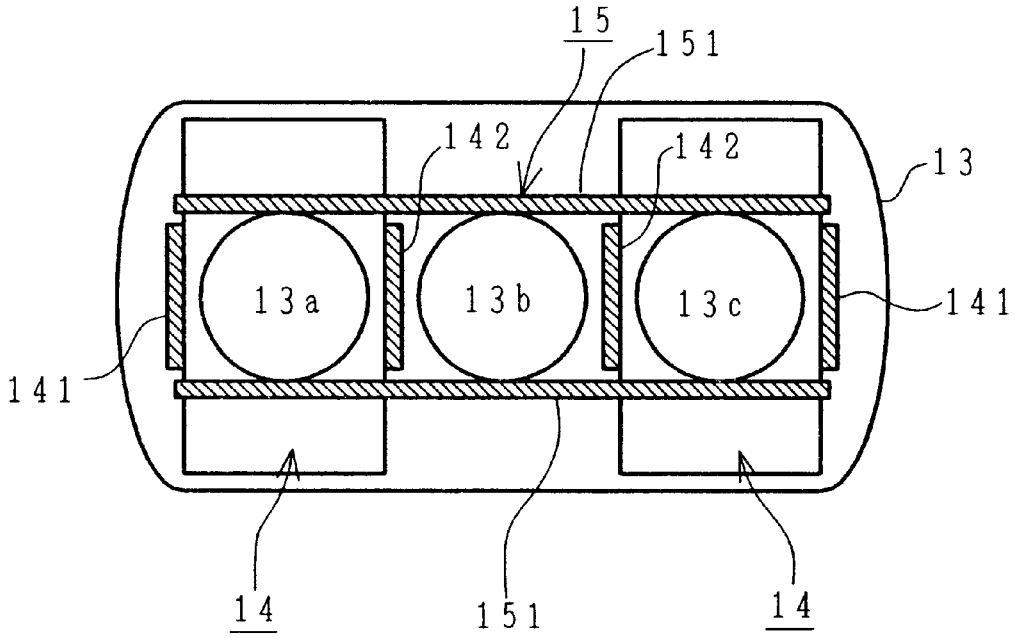
FIG. 5 is a cross-sectional view of a first G5 sub-electrode of FIG. 4 as viewed in the direction of arrows V—V in FIG. 4.
Figure 6:
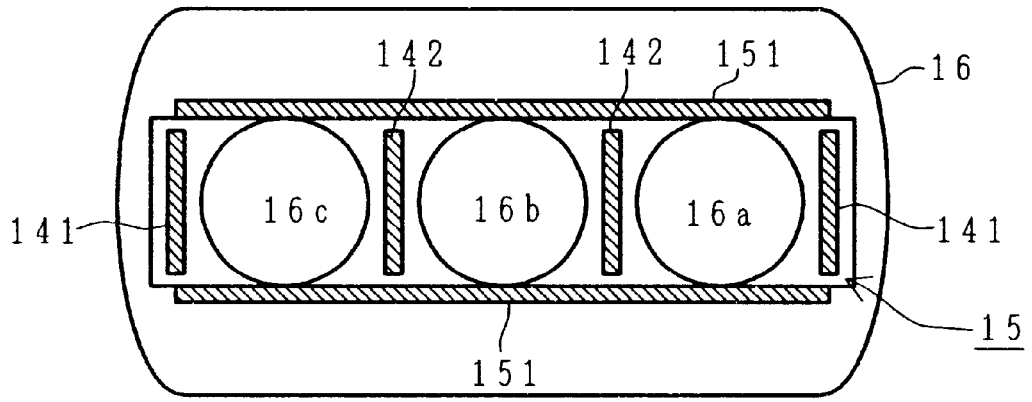
FIG. 6 is a cross-sectional view of a second G5 sub-electrode of FIG. 4 as viewed in the direction of arrows VI—VI in FIG. 4.

FIG. 5 is a cross-sectional view of the first G5 sub-electrode 13 of FIG. 4 as viewed in the direction of arrows V—V in FIG. 4, FIG. 6 is a cross-sectional view of a second G5 sub-electrode 16 of FIG. 4 as viewed in the direction of arrows VI—VI in FIG. 4, reference numerals 141, 142 denote vertical plates of the vertical electrode pieces 14, and reference numerals 151 denote the horizontal plates of the horizontal electrode piece 15.

As shown in FIG. 5, the first G5 sub-electrode 13 is formed with three circular electron beam apertures 13*a*, 13*b* and 13*c* corresponding to the three electron beams.

There are provided to each of the side electron beam apertures 13*a*, 13*c*, the vertical electrode piece 14 having a, horizontal cross section of a shape of a square bracket and having an electron beam aperture. The inner vertical plates 142 are disposed midway between the center of the center electron beam aperture 13*b* and the respective centers of the two side electron beam apertures 13*a*, 13*c*.

The outer vertical plates 141 are displaced outwardly the same distance from the respective centers of the side electron beam apertures 13*a*, 13*c* as the inner vertical plates 142 are displaced from the respective centers of the side electron beam apertures 13*a*, 13*c*. The axial length of the inner vertical plates 142 is made shorter than that of the outer vertical plates 141.

As shown in FIG. 6, the second G5 sub-electrode 16 is formed with three circular electron beam apertures 16*a*, 16*b* and 16*c* corresponding to the three electron beams in its end facing the first G5 sub-electrode 13, and the horizontal electrode piece 15 is attached to the second G5 sub-electrode such that its horizontal plates 151 are disposed above and below the electron beam apertures 16*a*, 16*b* and 16*c* and they extend toward the first G5 sub-electrode 13.

Each circular electron beam aperture corresponding to one of the three electron beams in the first G5 sub-electrode 13 is coaxial with and of the same diameter as a corresponding one of the circular electron beam apertures in the second G5 sub-electrode 16.

The first G5 sub-electrode 13 is supplied with a fixed focus voltage Vf1, the second G5 sub-electrode 16 is supplied with a voltage Vf2 which is a fixed focus voltage Vf1 superposed with a dynamic voltage dVf The dynamic voltage dVf is increased with increasing deflection of the electron beams. Incidentally, the second G5 sub-electrode 16 can be supplied with a focus voltage which is a fixed voltage Vf3 different from the fixed focus voltage Vf1, plus a dynamic voltage dVf. The second G5 sub-electrode 16 is supplied with a voltage Vf2 which is the fixed focus voltage Vf1 superposed with a dynamic voltage dVf.

The strength of the electrostatic quadrupole lens formed between the first and second G5 sub-electrodes 13, 16 increases with increase in the dynamic voltage dVf, to correct astigmatism caused by deflection of the electron beams.

The vertical electrode piece 14 having a horizontal cross section of a shape of a square bracket is attached to the first G5 sub-electrode 13 around the side electron beam apertures 13*a*, 13*c*, the axial thickness of the portion connecting the inner and outer vertical plates 141, 142 makes the lens forming space of the electrostatic quadrupole lens for the side electron beams smaller than that for the center electron beam, and therefore the strength of the electrostatic quadrupole lens for the side electron beams is weaker than that for the center electron beam. This difference in lens strength is offset by making the axial length of the inner vertical plates 142 than that of the outer vertical plates 141.

Simultaneously with the above, the lens strength of the final main lens decreases because of the decrease in the difference between the anode voltage Eb applied to the anode 17 and the voltage Vf2 applied to the second G5 sub-electrode 16, and the distance between the main lens and the beam focus point (the image point) becomes longer such that the electron beams are focused on the phosphor screen even at its periphery.

This means that, with the above structure of the electron gun, astigmatism and curvature of the image field can be corrected dynamically at the same time.

The strength of the final main lens decreases as the difference between the anode voltage Eb applied to the anode 17 and the voltage Vf2 applied to the second C5 sub-electrode 16 decreases with increase in the dynamic voltage dVf, and consequently the converging force for converging the two side electron beams toward the center electron beam decreases, but in this embodiment, the beam converging force produced in the region between the facing ends of the first and second G5 sub-electrodes 13, 16 increases with increasing dVf to reduce or eliminate variations in beam convergence caused by variations in dVf because the axial length of the inner vertical plates 142 are made shorter than that of the outer vertical plates 141.

Figure 7:
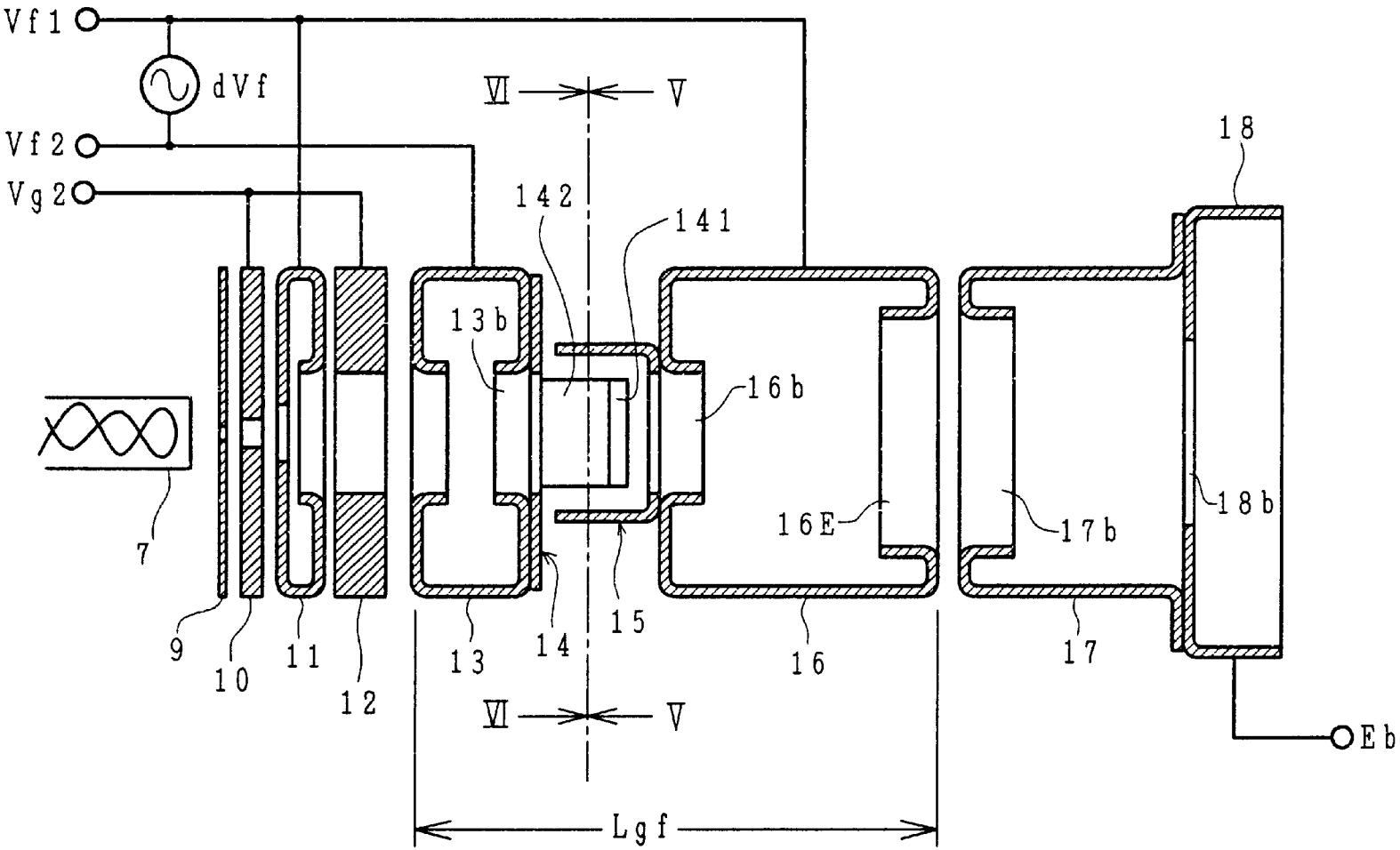
FIG. 7 is a schematic cross-sectional view of a second embodiment of an electron gun for a color cathode ray tube of the present invention.

FIG. 7 is a schematic cross-sectional view of a second embodiment of an electron gun of a color cathode ray tube of the present invention, taken along the center axis of the in-line type electron gun, as in FIG. 4.

A cross-sectional view of a first G5 sub-electrode 13 of FIG. 7 as viewed in the direction of arrows V—V in FIG. 7, and a cross-sectional view of a second G5 sub-electrode 16 of FIG. 7 as viewed in the direction of arrows VI—VI in FIG. 7 are shown in FIGS. 5 and 6, respectively.

In FIG. 7, the structure of the electron gun is the same as in the electron gun of FIG. 4, except that the G2 electrode 10 is electrically connected to the G4 electrode 12, the G3 electrode 11 is electrically connected to the second G5 sub-electrode 16, the G3 electrode 11 and the second G5 sub-electrode 16 are supplied with a common focus voltage Vf1 of about 5 kV to about 10 kV, and the first G5 sub-electrode 13 is supplied with a voltage Vf2 which is the fixed focus voltage Vf1 superposed with a dynamic voltage dvf. In this embodiment also, it is not necessary that the first G5 sub-electrode 13 and the second G5 sub-electrode 16 are supplied with the common DC focus voltage component.

The electron beam generating section (a triode section) comprising a cathode 7, a G1 electrode 9 and the G2 electrode projects three electron beams approximately in parallel with each other in a horizontal plane toward a phosphor screen (not shown).

The G3 electrode 11, the G4 electrode 12 and the first G5 sub-electrode 13 form the first-stage focus lens, and the second G5 sub-electrode 16 and the anode 17 form the second-stage focus lens for focusing the three electron beams on the phosphor screen. The vertical electrode pieces 14 and the horizontal electrode piece 15 are attached to the facing ends of the first and second G5 sub-electrodes 13, 16, respectively, to form an electrostatic quadrupole lens therebetween.

In this embodiment also, the focus electrode length Lgf (mm) the lens-screen distance Ls (mm) and the useful diagonal dimension D (mm) of the phosphor screen 3 satisfy the following inequalities as in the case of the first embodiment explained in connection with FIG. 1:

$$0.06 \times Ls\ (mm) \leqq Lgf\ (mm) \leqq 26\ (mm) \quad (1)$$

$$1.50 \leqq D/Ls \leqq 1.70 \quad (2),$$

where the focus electrode length Lgf (mm) is defined as the sum of axial lengths of the first G5 sub-electrode 13 and the second G5 sub-electrode 16 and the spacing therebetween which form an electrostatic quadrupole lens, or, if the first and second G5 sub-electrodes 13, 16 overlap each other, the sum of the axial lengths of the first and second 55 sub-electrodes 13, 16 minus the length of the overlap therebetween, that is, an axial distance from the end of the first G5 sub-electrode 13 on its cathode side to the end of the second G5 sub-electrode 16 on its anode side, as indicated in FIGS. 1 and 7, and the lens-screen distance Ls (mm) is defined as an axial distance measured from the end of the second G5 sub-electrode 16 on the G6 electrode 17 side thereof which forms a main lens in cooperation with the G6 electrode 17 serving as an anode to the phosphor screen 3.

This embodiment also provides a color cathode ray tube of capable of making a low dynamic voltage compatible with excellent focus characteristics and making its maximum diagonal deflection angle larger than 90° and its overall length shorter.

A third embodiment applies the present invention to an electron gun comprising a cathode and the G1 to G4 electrodes, while the first and second embodiments apply the present invention to the electron guns comprising a cathode and the G1 to G6 electrodes. The structure of this embodiment is the same as in the first and second embodiments explained in connection with FIG. 1, except for the structure of the electron gun.

Figure 8:
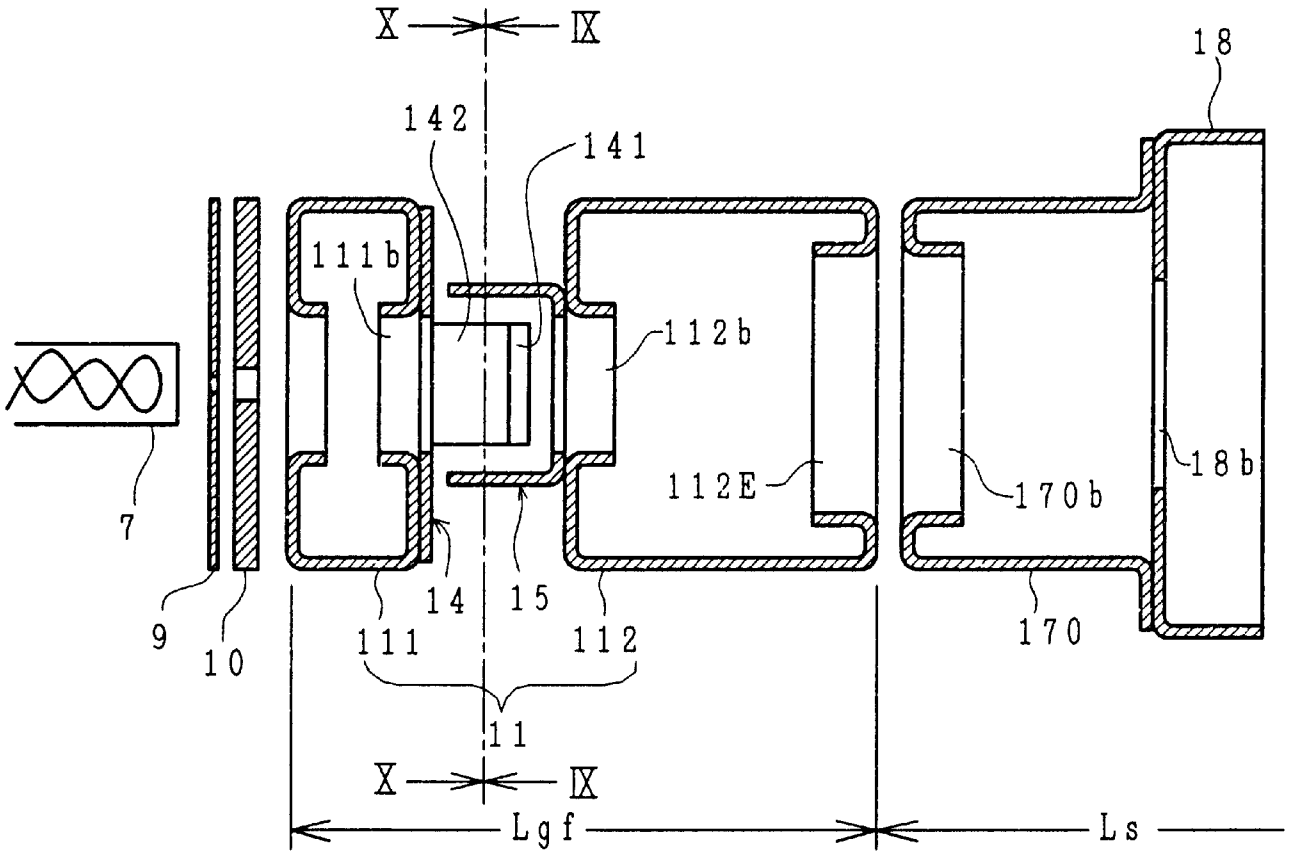
FIG. 8 is a schematic cross-sectional view of a third embodiment of an electron gun for a color cathode ray tube of the present invention.

FIG. 8 is a schematic cross-sectional view of the third embodiment of an electron gun of a color cathode ray tube of the present invention, taken along the center axis of the in-line type electron gun.

In FIG. 8, reference numeral 7 denotes a cathode for projecting a center electron beam, 9 is a GI electrode, 10 is a G2 electrode, 111 is a first G3 sub-electrode, 14 is a vertical electrode piece for forming an electrostatic quadrupole lens, 15 is a horizontal electrode piece for forming the electrostatic quadrupole lens in cooperation with the vertical electrode piece 14, 112 is a second G3 sub-electrode, 170 is a G4 electrode serving as an anode, and 18 is a shield cup.

Reference 111*b* denotes a center electron beam aperture in the first G3 sub-electrode 111, 112*b* is a center electron beam aperture in the end of the second G3 sub-electrode 112 facing the first G3 sub-electrode 111, 112 E is a center electron beam aperture in the end of the second G3 sub-electrode 112 facing the G4 electrode 170, 170*b* is a center electron beam aperture in the end of the G4 electrode 170 facing the second G3 sub-electrode 112, and 18*b* is a center electron beam aperture in the shield cup 18.

In this embodiment, the electron beam generating section (a triode section) comprising the cathode 7, the G1 electrode 9 and the G2 electrode projects three electron beams approximately in parallel with each other in a horizontal plane toward a phosphor screen (not shown), and then a combination of the G3 electrode 11 and the G4 electrode 170 serving as an anode focus the three electron beams on the phosphor screen.

The G3 electrode 11 is divided into the first G3 sub-electrode 111 and the second G3 sub-electrode 112 on this order from the cathode 7 side, and the electrostatic quadrupole lens is formed by the vertical electrode pieces 14 and the horizontal electrode piece 15 attached to the facing ends of the first and second G3 sub-electrodes 111, 112, respectively.

The following explains the structure of electrodes for forming the electrostatic quadrupole lens between the first G3 sub-electrode 111 and the second G3 sub-electrode 112.

Figure 9:
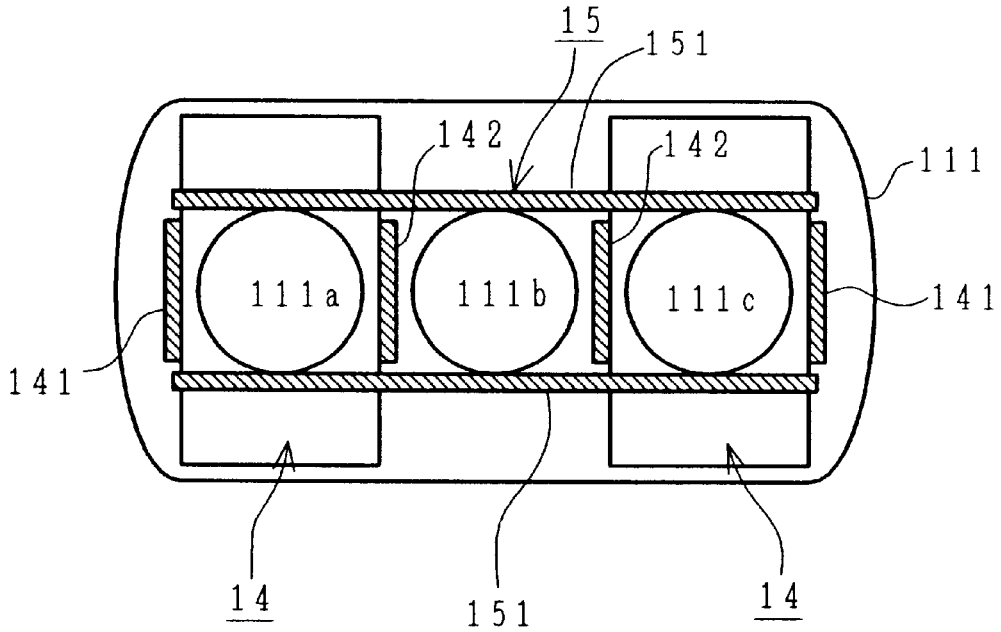
FIG. 9 is a cross-sectional view of a first G3 sub-electrode of FIG. 8 as viewed in the direction of arrows IX—IX in FIG. 8.
Figure 10:
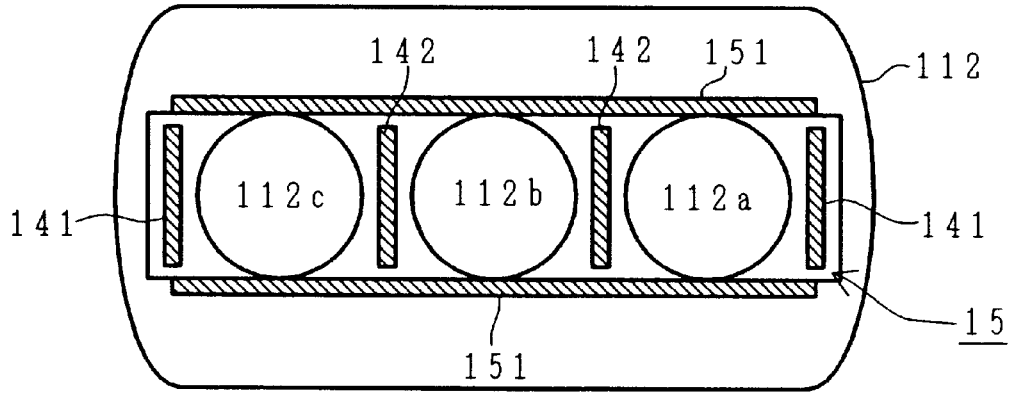
FIG. 10 is a cross-sectional view of a second G3 sub-electrode of FIG. 8 as viewed in the direction of arrows X—X in FIG. 8.

FIG. 9 is a cross-sectional view of the first G3 sub-electrode 111 of FIG. 8 as viewed in the direction of arrows IX—IX in FIG. 8, FIG. 10 is a cross-sectional view of a second G3 sub-electrode 112 of FIG. 8 as viewed in the direction of arrows X—X in FIG. 8, reference numerals 141, 142 denote vertical plates of the vertical electrode pieces 14, and reference numerals 151 denote the horizontal plates of the horizontal electrode piece 15. As shown in FIG. 9, the first G3 sub-electrode 111 is formed with three circular electron beam apertures 111*a*, 111*b* and 111*c* corresponding to the three electron beams.

There are provided to each of the side electron beam apertures 111*a*, 111*c*, the vertical electrode piece 14 having a horizontal cross section of a shape of a square bracket and having an electron beam aperture. The inner vertical plates 142 are disposed midway between the center of the center electron beam aperture 111*b* and the respective centers of the two side electron beam apertures 111*a*, 111*c*.

The outer vertical plates 141 are displaced outwardly the same distance from the respective centers of the side electron beam apertures 111*a*, 111*c* as the inner vertical plates 142 are displaced from the respective centers of the side electron beam apertures 111*a*, 111*c*. The axial length of the inner vertical plates 142 is made shorter than that of the outer vertical plates 141.

As shown in FIG. 10, the second G3 sub-electrode 112 is formed with three circular electron beam apertures 112*a*, 112*b* and 112*c* corresponding to the three electron beams in its end facing the first G3 sub-electrode 111, and the horizontal electrode piece 15 is attached to the second G5 sub-electrode such that its horizontal plates 151 are disposed above and below the electron beam apertures 112*a*, 112*b* and 112*c* and they extend toward the first G3 sub-electrode 111.

In this embodiment, the focus electrode length Lgf (mm), this lens-screen distance Ls (mm) and the useful diagonal dimension D (mm) of the phosphor screen 3 satisfy the following inequalities as in the case of the first and second embodiments:

$$0.06\times Ls\ (mm) \leqq Lgf\ (mm) \leqq 26\ (mm) \quad (1)$$

$$1.50 \leqq D/Ls \leqq 1.70 \quad (2),$$

where the focus electrode length Lgf (mm) is defined as the sum of axial lengths of the first G3 sub-electrode 111 and the second G3 sub-electrode 112 and the spacing therebetween which form an electrostatic quadrupole lens, or, if the first and second G3 sub-electrodes 111, 112 overlap each other, the sum of the axial lengths of the first and second G3 sub-electrodes 111, 112 minus the length of the overlap therebetween, that is, an axial distance from the end of the first G3 sub-electrode 111 on its cathode side to the end of the second G3 sub-electrode 112 on its anode side, as indicated in FIG. 8, and the lens-screen distance Ls (mm) is defined as an axial distance measured from the end of the second G3 sub-electrode 112 on the G4 electrode 170 side thereof which forms a main lens in cooperation with the G4 electrode 170 serving as an anode to the phosphor screen 3.

This embodiment also provides a color cathode ray tube of capable of making a low dynamic voltage compatible with excellent focus characteristics and making its maximum diagonal deflection angle larger than 90° and its overall length shorter.

As explained above, the present invention provides a color cathode ray tube capable of shortening its axial length by employing a deflection angle larger than 90°, making a dynamic focus voltage comparable to that of a conventional 90° deflection color cathode ray tube and retaining good focus characteristics.

What is claimed is:

1. A color cathode ray tube comprising:

a phosphor screen;

an in-line type electron gun comprising an electron beam generating section having a cathode, a beam control electrode and an accelerating electrode for projecting three electron beams of a center electron beam and two side electron beams arranged approximately in parallel with each other in a horizontal plane toward said phosphor screen, a focus electrode, and an anode adjacent to said focus electrode and forming a main lens in cooperation with said focus electrode for focusing said three electron beams on said phosphor screen; and a deflection yoke for deflecting said three electron beams horizontally and vertically;

said focus electrode including at least a first focus sub-electrode supplied with a first fixed focus voltage and a second focus sub-electrode supplied with a second fixed voltage superposed with a dynamic voltage varied in synchronism with deflection of said three electron beams on the order named from said cathode, said first focus sub-electrode and said second focus sub-electrode forming an electrostatic quadrupole lens therebetween;

said two side electron beams being deflected toward said center electron beam with increase of said dynamic voltage in said electrostatic quadrupole lens; and an axial distance Lgf (mm) measured from an end of said first focus sub-electrode on a cathode side thereof to an end of said second focus sub-electrode on an anode side thereof, an axial distance Ls (mm) measured from said end of said second focus sub-electrode to said phosphor screen, and a useful diagonal dimension D (mm) of said phosphor screen satisfying a following relationship:

$$0.06\times Ls\ (mm) \leqq Lgf\ (mm) \leqq 26\ (mm)$$

$$1.50 \leqq D/Ls \leqq 1.70.$$

2. A color cathode ray tube according to claim 1, wherein said axial distance Lgf and said axial distance Ls satisfy a following relationship:

$$0.06\times Ls\ (mm) \leqq Lgf\ (mm) \leqq 19\ (mm).$$

3. A color cathode ray tube according to claim 1, further comprising a shadow mask adjacent to said phosphor screen, wherein a pitch of dot apertures in said shadow mask is not larger than 0.28 mm.

4. A color cathode ray tube comprising:

a phosphor screen;

an in-line type electron gun comprising an electron beam generating section having a cathode, a beam control electrode and an accelerating electrode for projecting three electron beams of a center electron beam and two side electron beams arranged approximately in parallel with each other in a horizontal plane toward said phosphor screen, a focus electrode, and an anode adjacent to said focus electrode and forming a main lens in cooperation with said focus electrode for focusing said three electron beams on said phosphor screen; and a deflection yoke for deflecting said three electron beams horizontally and vertically;

said focus electrode including at least a first focus sub-electrode supplied with a first fixed focus voltage and a second focus sub-electrode supplied with a second fixed voltage superposed with a dynamic voltage varied in synchronism with deflection of said three electron beams on the order named from said cathode, said first focus sub-electrode and said second focus sub-electrode forming an electrostatic quadrupole lens therebetween;

said two side electron beams being deflected toward said center electron beam with increase of said dynamic voltage in said electrostatic quadrupole lens;

a maximum diagonal deflection angle of said three electron beams across said phosphor screen being larger than 90 degrees, but smaller than 110 degrees; and an axial distance Lgf (mm) measured from an end of said first focus sub-electrode on a cathode side thereof to an end of said second focus sub-electrode on an anode side thereof, and an axial distance Ls (mm) measured from said end of said second focus sub-electrode to said phosphor screen satisfying a following relationship:

$$0.06 \times Ls\ (mm) \leqq Lgf\ (mm) \leqq 26\ (mm).$$

5. A color cathode ray tube according to claim 4, wherein said axial distance Lgf and said axial distance Ls satisfy a following relationship:

$$0.06 \times Ls\ (mm) \leqq Lgf\ (mm) \leqq 19\ (mm).$$

6. A color cathode ray tube according to claim 4, further comprising a shadow mask adjacent to said phosphor screen, wherein a pitch of dot apertures in said shadow mask is not larger than 0.28 mm.

7. A color cathode ray tube comprising:

a phosphor screen;

an in-line type electron gun comprising an electron beam generating section having a cathode, a beam control electrode and an accelerating electrode for projecting three electron beams of a center electron beam and two side electron beams arranged approximately in parallel with each other in a horizontal plane toward said phosphor screen, a focus electrode, and an anode adjacent-to said focus electrode and forming a main lens in-cooperation with said focus electrode for focusing said three electron beams on said phosphor screen; and a deflection yoke for deflecting said three electron beams horizontally and vertically;

said focus electrode including at least a first focus sub-electrode supplied with a first fixed focus voltage and a second focus sub-electrode supplied with a second fixed voltage superposed with a dynamic voltage varied in synchronism with deflection of said three electron beams on the order named from said cathode, said first focus sub-electrode and said second focus sub-electrode forming an electrostatic quadrupole lens therebetween;

said two side electron beams being deflected toward said center electron beam with increase of said dynamic voltage in said electrostatic quadrupole lens;

a maximum useful diagonal dimension of said phosphor screen being greater than 410 mm;

a maximum diagonal deflection angle of said three electron beams across said phosphor screen being approximately 100 degrees; and an axial distance Lgf (mm) measured from an end of said first focus sub-electrode on a cathode side thereof to an end of said second focus sub-electrode on an anode side thereof, and an axial distance Ls (mm) measured from said end of said second focus sub-electrode to said phosphor screen satisfying a following relationship:

$$0.06 \times Ls\ (mm) \leqq Lgf\ (mm) \leqq 19\ (mm).$$

8. A color cathode ray tube according to claim 7, further comprising a shadow mask adjacent to said phosphor screen, wherein a pitch of dot apertures in said shadow mask is not larger than 0.28 mm.

* * * * *